United States Patent [19]

Weddendorf

[11] Patent Number: 5,052,152

[45] Date of Patent: Oct. 1, 1991

[54] DOUBLE FACE SEALING DEVICE

[75] Inventor: Bruce C. Weddendorf, Huntsville, Ala.

[73] Assignee: The United States of America as represented by the Administrator of the National Aeronautics and Space Administration, Washington, D.C.

[21] Appl. No.: 657,586

[22] Filed: Feb. 19, 1991

[51] Int. Cl.[5] ..... E06B 7/16

[52] U.S. Cl. ..... 49/495; 49/480; 49/482; 49/485; 49/493

[58] Field of Search ..... 49/475, 493, 480, 485, 49/495, 482; 244/117 A

[56] References Cited

U.S. PATENT DOCUMENTS

| | | | |
|---|---|---|---|
| 1,906,110 | 4/1933 | Sevison | 49/485 |
| 2,807,837 | 10/1957 | Kesling | 49/495 X |
| 3,284,957 | 11/1966 | Landis | 49/495 |
| 3,308,727 | 3/1967 | Hurt, Jr. | 49/485 |
| 3,327,429 | 6/1967 | Slaughter | 49/495 X |
| 3,777,424 | 12/1973 | Nagy et al. | 49/485 |
| 4,474,344 | 10/1984 | Bennett | 49/485 X |
| 4,535,565 | 8/1985 | Erickson | 49/485 X |
| 4,910,920 | 3/1990 | Nichols | 49/495 X |

*Primary Examiner*—Philip C. Kannan

*Attorney, Agent, or Firm*—Robert L. Broad, Jr.; Jerry L. Seemann

[57] ABSTRACT

A double face sealing device for mounting between two surfaces to provide an airtight and fluid-tight seal between a closure member bearing one of the surfaces and a structure or housing bearing the other surface which extends around the opening or hatchway to be closed. The double face sealing device includes a plurality of sections or segments mounted to one of the surfaces, each having a main body portion, a pair of outwardly extending and diverging, cantilever, spring arms, and a pair of inwardly extending and diverging, cantilever, spring arms, an elastomeric cover on the distal, free, ends of the outwardly extending and diverging spring arms, and an elastomeric cover on the distal, free, ends of the inwardly extending and diverging spring arms. The double face sealing device has application or use in all environments requiring a seal, but is particularly useful to seal openings or hatchways between compartments of spacecraft or aircraft.

20 Claims, 3 Drawing Sheets

DOUBLE FACE SEALING DEVICE

ORIGIN OF THE INVENTION

The invention described herein was made by an employee of the United States Government and may be manufactured and used by or for the Government for governmental purposes without the payment of any royalties thereon or therefor.

FIELD OF THE INVENTION

The present invention relates to a double face sealing device for mounting between two surfaces to provide an airtight and fluid-tight seal between a closure member bearing one of the surfaces and a structure or housing bearing the other surface which extends around the opening or hatchway to be closed. The double face sealing device of the present invention is particularly adapted for providing an easily renewable, long-term, ultra low leakage seal for use in spacecraft or aircraft to contain the atmosphere therein, but it is also useful in almost all environments requiring a seal between compartments or between a compartment and the outside thereof.

BACKGROUND OF THE INVENTION

There are many prior art devices for sealing a closure member and an opening or hatchway in a housing. A vast majority of such prior part devices provide only a single seal and not a redundant or double seal as does the present invention. None of the known prior art devices are suitable for long term use on spacecraft or aircraft to seal low pressure atmosphere against vacuum. Most known prior art devices used with spacecraft or aircraft include elastomeric O-rings and other purely elastomeric seals, metal seals, elastomeric seals molded into metal gasket plates, or internally sprung elastomeric or plastic seals.

There are also various patents which relate to devices for providing a seal between adjacent surfaces of a closure member and a compartment. These patents generally teach the use of a single seal only which is not normally intended for use in spacecraft or aircraft. U.S. Pat. No. 2,686,343 discloses a sealing device for a pressurized aircraft including an elongated elastomeric tube. U.S. Pat. No. 3,308,727 discloses a sealing device for use between a manhole and a manhole cover comprising a cushioning ring having an outer ring member and an inner ring member having diverging arms. U.S. Pat. No. 3,763,595 discloses an elastomeric seal for providing a fluid-tight seal between a closure member and a structure extending around the opening of a hatchway. U.S. Pat. No. 3,777,424 discloses a weather seal for a railway car door, which seal is formed of an elastomeric material. U.S. Pat. Nos. 1,906,110, 2,827,280, 3,284,957, 4,474,344, and 4,535,565 are illustrative of other prior art devices for sealing between compartments or between a compartment and the outside thereof.

The prior art sealing devices, particularly when used on spacecraft or aircraft, have numerous disadvantages or drawbacks. For example, those sealing devices which rely upon an elastomer to maintain the sealing contact force are subject to failure over a period of time due to the compression set of the elastomer and it is extremely difficult to replace the elastomer only. Metal seals normally require large clamping forces to seal, thus necessitating stiff, heavy, flanges which are not adaptable for lightweight spacecraft or aircraft. Currently available metal seals and internally sprung elastomeric or plastic seals are extremely, rigid and of one piece, and, if used on a circular opening or hatchway, cannot fit through the opening or hatchway to be sealed. Most prior art sealing devices also require a relatively large space for storage of spares and are difficult to mount. Many of the prior art sealing devices also require special machining since they are mounted in a recess or groove. Many prior art sealing devices are not constructed such as to permit the replacement of the elastomeric material only, but require the replacement of the entire sealing device.

The present invention overcomes the numerous disadvantages, drawbacks or deficiencies of the prior art devices in that it provides a redundant (two sealing points) elastomeric seal energized by metal springs while allowing the easy replacement of the elastomers independently of the metal springs. The metal springs maintain the stress in the elastomers over a very long period of time, well beyond the time a pure elastomeric seal would have failed due to compression set. The surfaces which the seal of the present invention interfaces with can be smooth, with no special machining being required except for simple tapped retention holes; thus lowering costs and simplifying the elastomer replacement process.

Accordingly, it is an object of the present invention to provide a new and improved device for sealing the opening or hatchway between two compartments or one compartment and the outside.

It is a further object of the present invention to provide a double face device for mounting between two surfaces to provide an airtight and fluid-tight seal between the surfaces.

It is still a further object of the present invention to provide an easily replaceable, long lasting, ultra low leakage seal for use in a spacecraft or aircraft to contain the atmosphere therein.

It is yet a further object of the present invention to provide a long lasting, redundant (two sealing points), elastomeric seal energized by metal springs which maintain the stress in the elastomeric seal over a very long period of time, well beyond the time a pure elastomeric seal would have failed due to compression set.

Other aspects, objects, and advantages of this invention will become apparent to those skilled in the art to which this invention pertains from a study of the preferred embodiments as set forth in the specifications, drawings, and the appended claims.

DETAILED DESCRIPTION OF THE DRAWINGS

Figure 1:
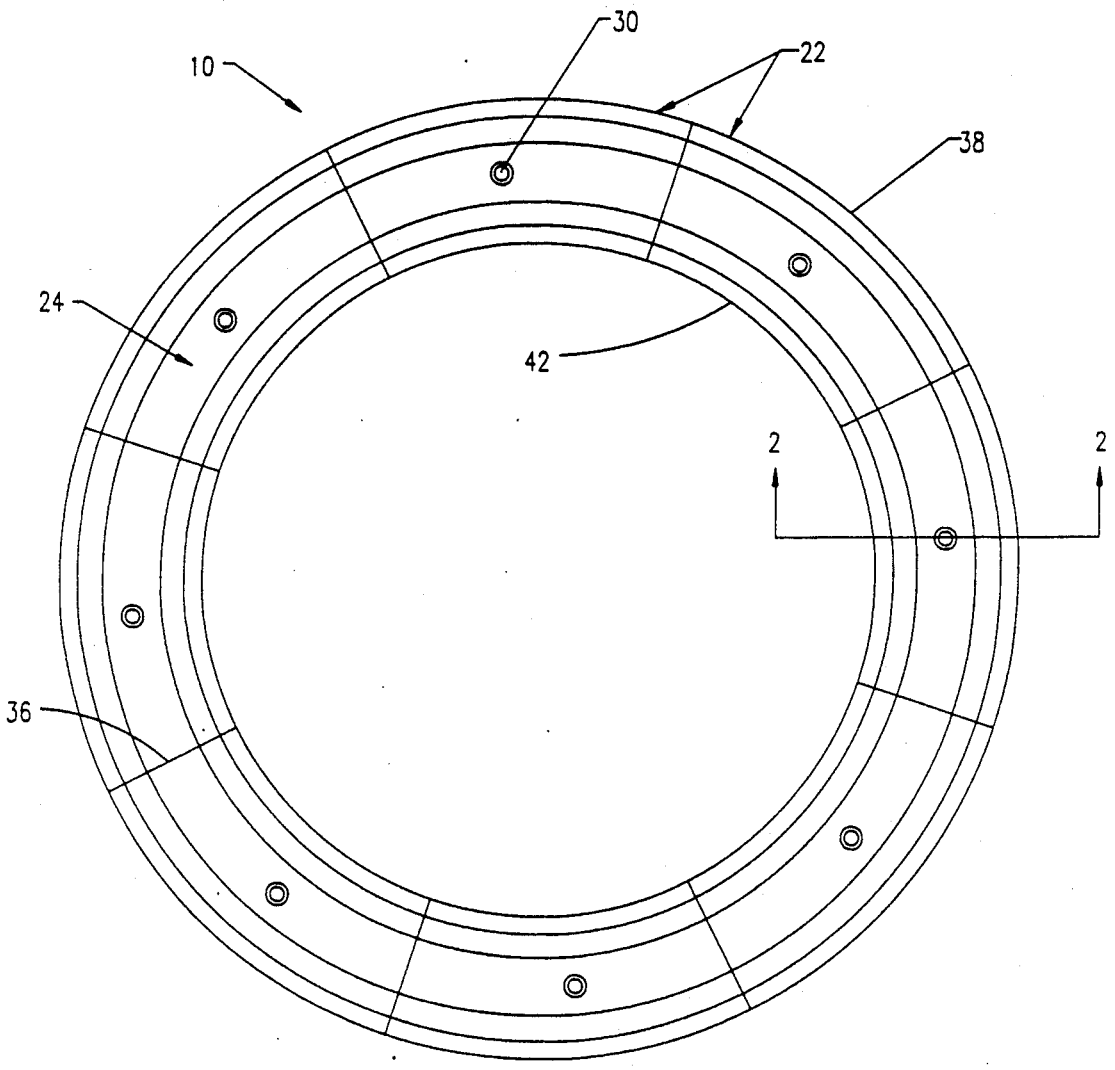
FIG. 1 is a top plan view of the double face sealing device of the present invention.
Figure 2:
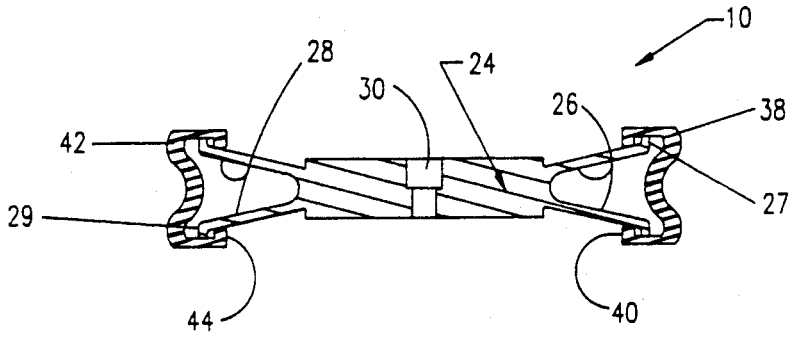
FIG. 2 is a sectional view taken along line 2—2 of FIG. 1 illustrating one embodiment of the sealing device of the present invention.
Figure 3:
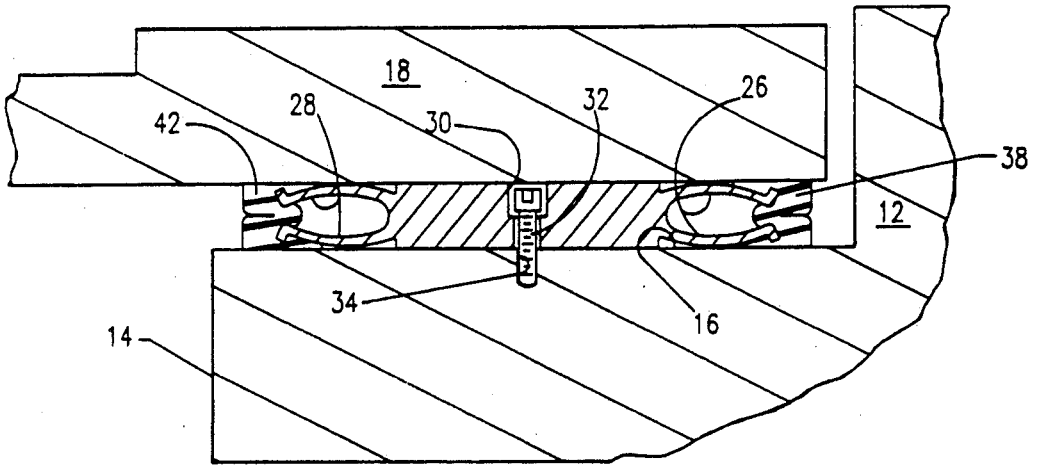
FIG. 3 is a partially broken away, fragmentary, view showing the sealing device of FIG. 2 in a compressed or sealing state.

Referring to the drawings, FIGS. 1–3 are illustrative of one embodiment or application of the seal of the present invention. As illustrated, the seal is generally designated by reference numeral 10 and is shown in a circular configuration for sealing a round opening or hatchway 14 (FIG. 3) in a housing or compartment 12 by a door or hatch 18. Seal 10 comprises a plurality of sections or segments 22, each having a main body portion 24, a pair of outwardly extending and diverging, cantilever, spring arms 26, a pair of inwardly extending and diverging, cantilever, spring arms 28, and a countersunk hole 30. Each spring arm 26 includes a projection 27 at its distal end which extends outwardly from spring arm 26 at an angle in the order of 70 degrees to 100 degrees with each spring arm 28 including a projection 29 at its distal end which extends outwardly from spring arm 28 at an angle in the order of 70 degrees to 100 degrees. Each section or segment 22 is secured to a shoulder or surface 16 (FIG. 3) of housing or compartment 12 which surrounds the opening or hatchway 14 by threaded fasteners 32 engaged with spaced, tapped, retention holes 34 in shoulder or surface 16 of housing or compartment 12. Reference numeral 36 designates the break lines between sections or segments 22. An outer, replaceable, elastomeric cover 38, including a pair of inwardly extending flanges 40, is placed or slipped over the ends of diverging spring arms 26, with the inwardly extending flanges 40 being snapped over the projections 27 for grasping the diverging spring arms 26, to positively retain the outer elastomeric cover 36 upon spring arms 26. An inner, replaceable, elastomeric cover 42, including a pair of inwardly extending flanges 44, is placed or slipped over the ends of diverging spring arms 28, with the inwardly extending flanges 44 being snapped over the projections 29 for grasping the diverging spring arms 28, to positively retain the inner elastomeric cover 42 upon spring arms 28.

Figure 4:
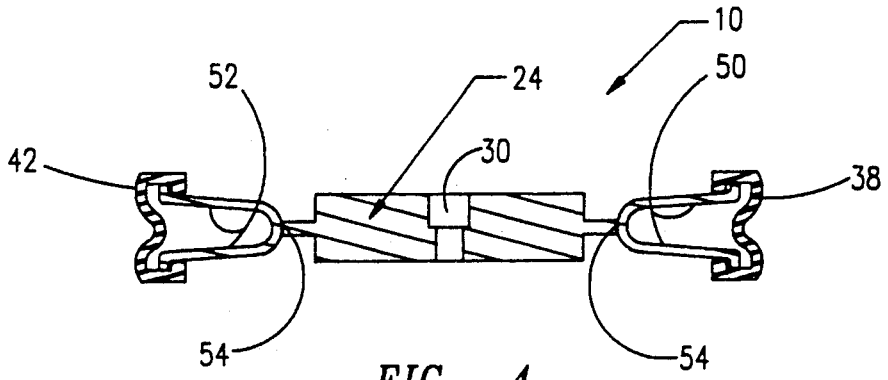
FIG. 4 is a view similar to FIG. 2 illustrating another embodiment of the sealing device of the present invention.

The embodiment of the sealing device as illustrated in FIG. 4 is substantially identical to that shown in FIGS. 1–3 except that the spring arms 50 and 52 are formed separately from the main body portions 24 and are secured to main body portions 24 by any conventional means such as a weld 54 instead of being formed integral with the main body portion as is done with the embodiment of the invention illustrated in FIGS. 1–3. The embodiment of the invention illustrated in FIG. 4 might be considered in environments wherein the hatchway or opening between the compartments are relatively large.

Figure 5:
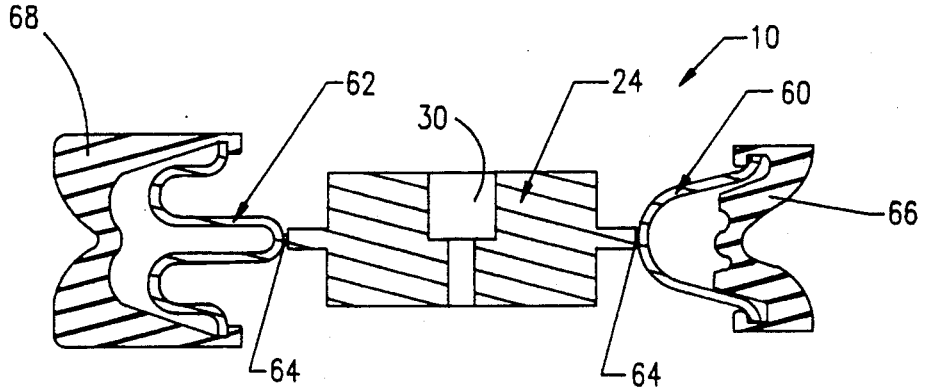
FIG. 5 is a view similar to FIG. 2 illustrating a further embodiment of the sealing device of the present invention.

The embodiment of the sealing device as illustrated in FIG. 5 is substantially identical to that shown in FIGS. 1–3 except that one spring arm 60 is generally C-shaped in cross-section and the other spring arm 62 is generally E-shaped or serpentine in cross-section, with both spring arms 60 and 62 being formed separately from the main body, portion 24 and being secured to main body portions 24 by any conventional means such as a weld 64 instead of being formed integral with the main body portion as is done with the embodiment of the invention illustrated in FIGS. 1–3. In the embodiment illustrated in FIG. 5, the elastomeric covers 66 and 68 are of different configurations with the cross-section of the cover for the C-shaped spring arms 60 being as represented by cover 66 with the cross-section of the cover for the spring arms 62 being as represented by cover 68. With the embodiment of the invention illustrated in FIG. 5, it is possible to utilize pressure activation for both sides of seal 10 by reversing the direction of the outer seal.

Figure 6:
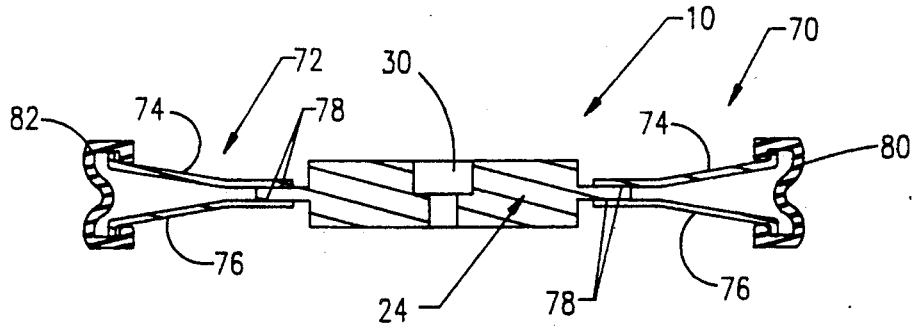
FIG. 6 is a view similar to FIG. 2 illustrating yet another embodiment of the sealing device of the present invention.

The embodiment of the sealing device as illustrated in FIG. 6 is substantially identical to that shown in FIG. 1–3 except that each spring arm 70 and 72 is formed of two independent members 74 and 76 separately from the main body portions 24 and are secured to main body portions 24 by any conventional means such as a weld 78 instead of being formed integral with the main body portion as is done in FIGS. 1–3. In the embodiment of FIG. 6, the outer elastomer is designated by reference numeral 80 and the inner elastomer is designated by the reference numeral 82.

Only the mode of operation of the embodiment of FIGS. 1–3 will be described, as the operation of the other embodiments are similar and will be obvious after learning of the operation of this embodiment. When it is desirable to cause a seal between door or hatch 18 and housing or compartment 12, the door or hatch 18 is moved toward the housing or compartment 12 to compress spring arms 26 and 28 and their respective covers 38 and 42 (from their cross-sectional shapes as shown in FIG. 2 to their cross-sectional shapes as shown in FIG. 3) so that the spring arms 26 and 28 and covers 38 and 42 deflect and carry loads. The relative movement continues until the flat lower surface of door or hatch 18 engages the flat upper surface of main body portions 24, at which point the seal 10 is fully compressed as shown in FIG. 3. The sealing force is maintained by the action of the now deformed cantilever spring arms 26 and 28 and their respective elastomeric covers 38 and 42, thus providing two independent sealed interfaces, one at elastomeric cover 38 and the other at elastomeric cover 42. When in a sealed state as shown in FIG. 3, the fasteners 32 float in countersunk openings 30, which are deep enough to prevent interference of the heads of fasteners 32 with the lower surface of door or hatch 18.

While the drawings depict the seal 10 as being circular or round and formed in sections or segments, it is apparent that seal 10 can be of other configurations such as being square, rectangular or ellipse, depending upon the shape of the hatchway or opening 14, and can be formed of a single main body portion instead of a plurality of sections or segments without departing from the spirit or scope of the invention. The drawings depict the main body portions in sections or segments to allow easy storage of replacement parts (segments and elastomeric covers) in a minimum area which is most important in a spacecraft on a mission of long duration.

It is also apparent that the spring arms must be sized for any given application or environment to provide sufficient sealing stress in the elastomeric covers with a margin for compression set and deflection without becoming plastically deformed.

While not shown in the drawings, it is apparent that conventional means such as hinges may be used to mount the hatch or door 18 to a housing or compartment 12 to allow relative movement and that conventional means such as latch or lock means must be used to prevent door or hatch 18 from separating to break the seal.

While the drawings illustrate the sealing 10 as being mounted on the housing or compartment 12, it is apparent that seal 10 can be mounted on the door or hatch 18 without departing from the spirit and scope of the invention.

While the above description constitutes preferred embodiments of the present invention, it will be appreciated that the invention is susceptible to modification, variation and change without departing from the proper scope and fair meaning of the accompanying claims.

I claim:

1. A seal for sealing relation between a pair of substantially parallel surfaces comprising:

a main body having a pair of spaced side edges, each side edge having a bifurcated spring member extending therefrom, and a resilient member disposed on the distal ends of each said bifurcated spring member in enclosing relation with said distal and; and means for securing said main body to one of said substantially parallel surfaces.

2. The seal of claim 1 wherein each of said resilient members is formed of a elastomeric material.

3. The seal of claim 2 wherein said means for securing said main body to one of said substantially parallel surfaces comprises a plurality of countersunk bores in said main body, a plurality of tapped retaining holes in said one substantially parallel surface, and a threaded bolt extending through each of said countersunk bores into one of said tapped holes.

4. The seal of claim 3 wherein said seal is formed of a plurality of segments, with each segment including a portion of said main body and at least one of said countersunk bores.

5. The seal of claim 4 wherein said bifurcated spring members are made integral with their respective said main body.

6. The seal of claim 4 wherein said bifurcated spring members are formed separately from said main body and are welded to said main body.

7. The seal of claim 6 wherein one of said bifurcated spring members is generally E-shaped in cross section and the other of said bifurcated spring members is generally C-shaped in cross section.

8. A double face device for sealing the space between a pair of substantially parallel surfaces, said device comprising:

a main body having a pair of outwardly extending and diverging spring arms and a pair of inwardly extending and diverging spring arms;

an outer cover mounted on said outwardly extending and diverging spring arms of said main body having a pair of inwardly extending flanges for grasping the free ends of said outwardly extending and diverging spring arms for holding said outer cover on said outwardly extending and diverging spring arms;

an inner cover mounted on said inwardly extending and diverging spring arms of said main body having a pair of inwardly extending flanges for grasping the free ends of said inwardly extending and diverging spring arms for holding said inner cover on said inwardly extending and diverging spring arms; and means for securing said main body to one of said substantially parallel surfaces.

9. The double face sealing device of claim 8 wherein said outer and inner covers are formed of a elastomeric material.

10. The double face sealing device of claim 9 wherein said means for securing said main body to one of said substantially parallel surfaces comprises a plurality of countersunk bores in said main body, a plurality of tapped retaining holes in said one substantially parallel surface, and a threaded bolt extending through each of said countersunk bores into one of said tapped holes.

11. The double face sealing device of claim 10 wherein said device is formed of a plurality of segments, with each segment including a portion of said main body and at least one of said countersunk bores.

12. The double face sealing device of claim 11 wherein said inwardly and outwardly extending and diverging spring arms are made integral with their respective said main body.

13. The double face sealing device of claim 11 wherein said inwardly and outwardly extending and diverging spring arms are formed separately from said main body and are welded to said main body.

14. The double face sealing device of claim 15 wherein one of said inwardly extending and diverging spring arms and said outwardly extending and diverging spring arms is generally E-shaped in cross section and the other of said diverging spring arms is generally C-shaped in cross section.

15. In a spacecraft having at least one compartment having a door frame including a flat frame edge portion defining a door opening, a door for said opening including a flat door edge portion generally conforming to said flat frame edge portion and being movable substantially laterally with respect to said flat frame edge portion of said door frame for closing said door opening, a double face seal device comprising:

a main body having a pair of outwardly extending and diverging spring arms and a pair of inwardly extending and diverging spring arms;

an outer cover mounted on said outwardly extending and diverging spring arms of said main body having a pair of inwardly extending flanges for grasping the free ends of said outwardly extending and diverging spring arms for holding said outer cover on said outwardly extending and diverging spring arms;

an inner cover mounted on said inwardly extending and diverging spring arms of said main body having a pair of inwardly extending flanges for grasping the free ends of said inwardly extending and diverging spring arms for holding said inner cover on said inwardly extending and diverging spring arms; and means for securing said main body to one of said flat edge portions of said door frame and said door.

16. The double face seal device of claim 15 wherein said outer and inner covers are formed of an elastomeric material.

17. The double face seal device of claim 16 wherein said means for securing said main body to one of said flat edge portions of said door frame and said door comprises a plurality of countersunk bores in said main body, a plurality of tapped retaining holes in said one flat edge portion of said door frame and said door, and a threaded bolt extending through each of said countersunk bores into one of said tapped holes, and wherein said device is formed of a plurality of segments, with each segment including a portion of said main body and at least one of said countersunk bores.

18. The double face sealing device of claim 17 wherein said inwardly and outwardly extending and diverging spring arms are made integral with their respective said main body.

19. The double face sealing device of claim 17 wherein said inwardly and outwardly extending and diverging spring arms are formed separately from said main body and are welded to said main body.

20. The double face sealing device of claim 19 wherein one of said inwardly extending and diverging spring arms and said outwardly extending and diverging spring arms is generally E-shaped in cross section and the other of said diverging spring arms is generally C-shaped in cross section.

* * * * *